US005168843A

United States Patent [19]

Franks

[11] Patent Number: 5,168,843

[45] Date of Patent: Dec. 8, 1992

[54] POPPET VALVE FOR AN INTERNAL COMBUSTION ENGINE

[76] Inventor: James W. Franks, 2153 Driftwood Cir., Palm Beach Gardens, Fla. 33410

[21] Appl. No.: 808,669

[22] Filed: Dec. 17, 1991

[51] Int. Cl.[5] ..... F01L 3/20

[52] U.S. Cl. ..... 123/188.3; 123/188.2

[58] Field of Search ..... 123/188.3, 188.2; 29/888.45

[56] References Cited

U.S. PATENT DOCUMENTS

| | | | |
|---|---|---|---|
| 1,423,876 | 7/1922 | Pfantsichl | 123/188.3 |
| 1,467,414 | 9/1923 | Bachman | 123/188 R |
| 1,557,829 | 10/1925 | Greiner et al. | 123/188.9 |
| 1,728,500 | 9/1929 | Martorell | 123/188 S |
| 2,089,636 | 8/1937 | Wurtele | 123/188.9 |
| 2,371,548 | 3/1945 | Saffady | 123/188.3 |
| 2,410,190 | 10/1946 | Townhill | 29/888.45 |
| 2,882,886 | 4/1959 | Butcher, Jr. | 123/188.3 |
| 3,710,773 | 1/1973 | Piech et al. | 29/888.45 |
| 3,871,339 | 3/1975 | Kuhn | 29/888.45 |
| 3,881,459 | 5/1975 | Gaetcke | 123/188 R |
| 4,688,527 | 8/1987 | Mott et al. | 123/188.9 |
| 4,779,584 | 10/1988 | Mosler | 123/188.3 |

FOREIGN PATENT DOCUMENTS

| | | | |
|---|---|---|---|
| 0712125 | 9/1941 | Fed. Rep. of Germany | 29/888.45 |

*Primary Examiner*—E. Rollins Cross
*Assistant Examiner*—Erick Solis

[57] ABSTRACT

Disclosed is a poppet valve for an internal combustion engine. The poppet valve includes an internal port which provides a second flow path for fuel-air mixture entering the combustion chamber. The valve body includes two annular seals which cooperate with two annular seats in the cylinder head of the engine to seal the valve when the valve body is in a closed position.

20 Claims, 15 Drawing Sheets

POPPET VALVE FOR AN INTERNAL COMBUSTION ENGINE

DESCRIPTION

1. Field of the Invention

This invention relates to poppet valves such as the type used in cylinder heads of internal combustion engines.

2. Background of the Invention

With a conventional poppet valve, such as the type used in internal combustion piston engines and disclosed in U.S. Pat. No. 3,494,336 to Myers et al, the maximum amount of air and fuel that can flow past the valve is limited because the body of the valve lies directly in the flowpath of the gaseous fuel mixture flowing from the intake passage into the combustion chamber. For internal combustion engines in particular, at small openings conventional inlet valves are subject to "throttling", a condition in which the piston is unable to draw enough fuel/air mixture past the partially opened valve. Prior methods to increase flow past poppet valves in internal combustion engines have included increasing valve size and lift. Also, single inlet valves have been replaced with multiple inlet valves, and valve angle has been tilted to form the shape of a hemispherical combustion chamber (the "hemi-head"). Although successful in obtaining improvement in flow, these designs incurred penalties such as greater design complexity and prohibitive costs of manufacture and assembly. Additionally, some of these designs result in a slight decrease in net engine performance due to increased reciprocating mass and friction which also results in increased wear. These problems have generally discouraged incorporation of these schemes into "stock" cylinder head design.

What is needed is a simple poppet valve which provides increased flow over conventional poppet valves without incurring the penalties of poppet valves of the prior art.

SUMMARY OF THE INVENTION

It is therefore an object of the present invention to provide a poppet valve which provides a greater flow volume than conventional poppet valves, especially at small openings.

Another object of the present invention is to provide a poppet valve which increases turbulence and decreases the throttling that occurs with conventional valves at small openings.

Another object of the present invention is to provide a poppet valve which, when used as an intake valve in an internal combustion engine provides increased engine efficiency and power output.

Another output of the present invention is to provide a poppet valve that is compatible with both iron and aluminum cylinder heads and is suitable for ceramic components.

Another object of the present invention is to provide a poppet valve which can be retrofitted to existing cylinder head designs.

Another object of the present invention is to provide a poppet valve having an internal port, which can be sealed by one of several central seat supports.

Another object of the present invention is to provide a poppet valve which can be keyed to a valve guide by one or more means.

Another object of the present invention is to provide a poppet valve which when used in an internal combustion engine with non-variable timing will produce high power output at low and medium, as well as high, r.p.m. (revolutions per minute).

Another object of the present invention is to provide a poppet valve which has two coaxial seals which can be surfaced simultaneously using alignment boring techniques.

Another object of the present invention is to provide a poppet valve that, as an exhaust valve, requires less force to open than conventional poppet valves.

Another object of the present invention is to provide a poppet valve that may be cast into a cylinder head simultaneous with the casting thereof.

According to the present invention, a poppet valve is provided having a valve body including first and second opposed faces and an internal port extending therebetween. A superior portion for positioning the valve body is connected to the first face, which includes first and second annular sealing surfaces. The first sealing surface is coaxial with the second sealing surface and tapers toward the superior portion. The second sealing surface surrounds an opening of the internal port and tapers toward the second face. A cylinder head design for an intrnal combustion engine is likewise disclosed which provides annular seats with which the first and second sealing surfaces cooperate to selectively open or close the valve.

The foregoing and other features and advantages of the present invention will become more apparent from the following description and accompanying drawings.

BRIEF DESCIPTION OF THE DRAWINGS

BEST MODE FOR CARRYING OUT THE INVENTION

Figure 1:
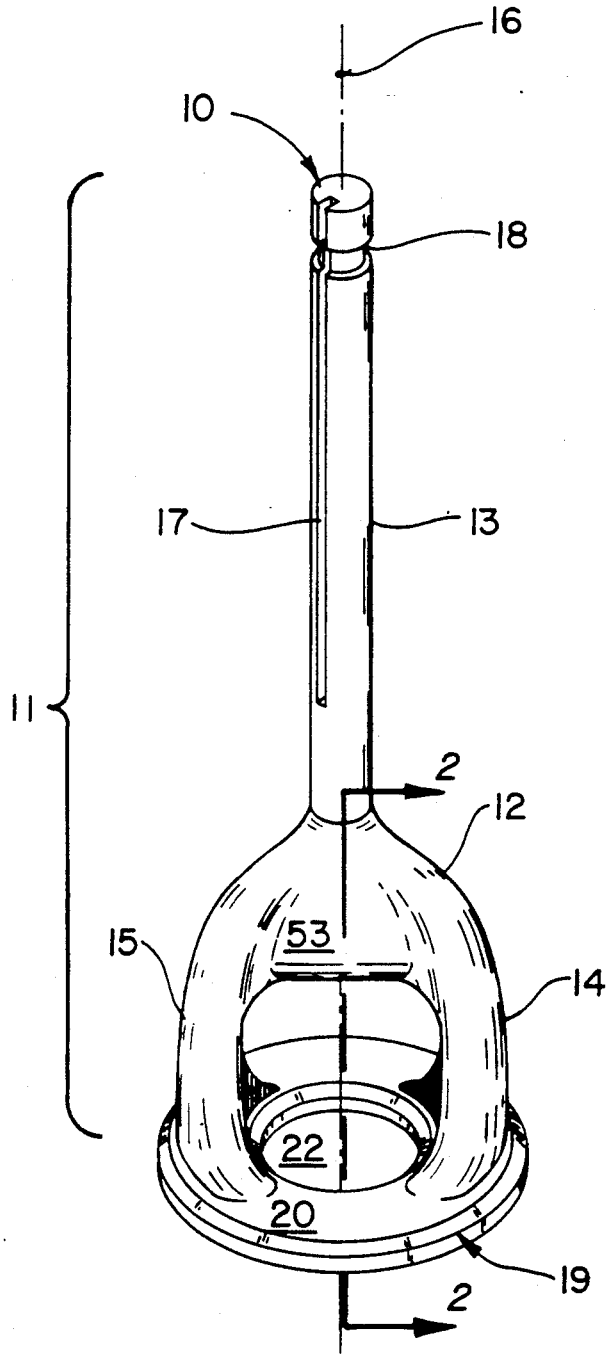
FIG. 1 is an elevational view of the poppet valve of the present invention.

The poppet valve 10 of the present invention has a superior portion 11 including a hub 12, a stem 13, and two posts 14, 15 as shown in FIG. 1. The stem 13 extends away from hub 12 along the longitudinal axis 16 of the poppet valve 10 while the posts 14, 15 extend from the hub 12 in a direction substantially parallel to the longitudinal axis 16 away from the stem 13. As used herein, the phrase "substantially parallel" means that the angle formed by either post 14, 15 and the longitudinal axis 16 is less than approximately twenty degrees. The stem 13 includes an axial slot 17 and an annular groove 18, the purposes of which are discussed in greater detail below.

Figure 2:
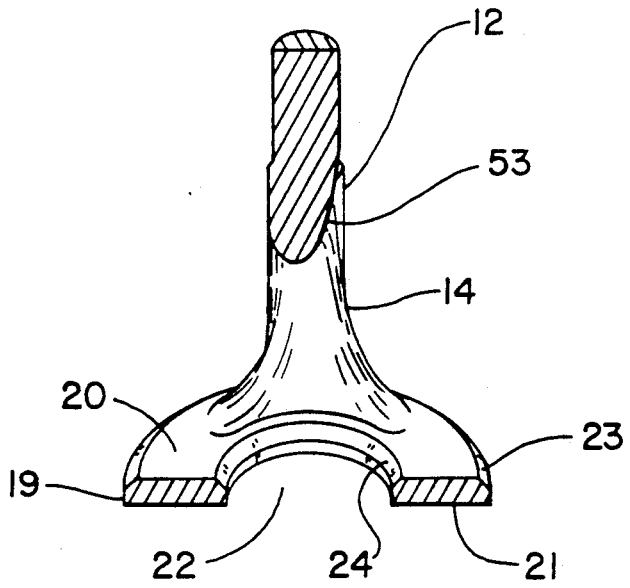
FIG. 2 is a cross-sectional view of the valve body taken along line 2—2 of FIG. 1.
Figure 3:
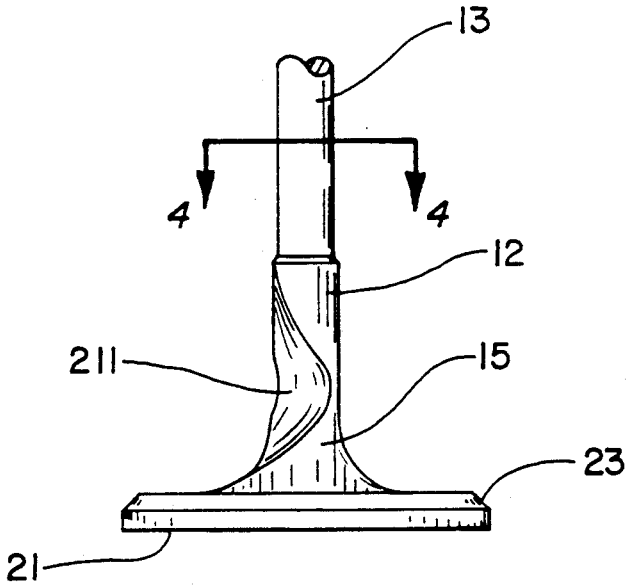
FIG. 3 is a side view of a portion of the poppet valve of the present invention showing the curvature of the hub and posts.
Figure 4:
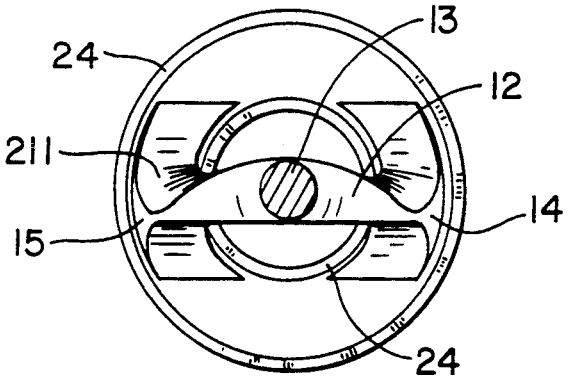
FIG. 4 is a top view of a portion of the poppet valve of the present invention taken along line 4—4 of FIG. 3 showing the curvature of the hub and posts.

The valve body 19 is disk shaped, having an inner face 20 to which the posts 14, 15 are attached, and opposite the inner face 20 is an outer face 21 as shown in FIG. 2. An internal port 22 concentric with the longitudinal axis 16 in the valve body 19 extends from the inner face 20 to the outer face 21, allowing communication therebetween. The inner face 20 has two annular sealing surfaces, a peripheral seal 23, and an inner seal 24, which are coaxial. The peripheral seal 23 tapers towards the inner face 20 of the valve body 19 as in conventional poppet valves, while the inner seal 24 tapers towards the outer face 21 of the valve body 19 and is immediately adjacent and encompasses the internal port 22. It is important to note that the inner seal 24 tapers toward the outer face 21, since this taper is critical to the sealing operation of the inner seal 24 when the valve 10 is incorporated into a cylinder head, as discussed below. As shown in FIG. 2, the internal port consists of a single opening through the valve body 19. Those skilled in the art will readily appreciate that this single opening provides the least restrictive flow path through the valve body 19. Depending on the design of the cylinder head into which the valve 10 is to be installed, one side of the hub 12 may include a curved portion 211 having a radius of curvature approximately equal to that of the peripheral seal 23, as shown in FIGS. 3 and 4, to allow for the valve 10 to be inserted into a cylinder head. As shown in FIG. 1, a depression 53 may likewise be included in the hub 12 oppposite the curved portion 211. The curved portion 211 and the depression 53 are discussed in greater detail below.

Figure 5:
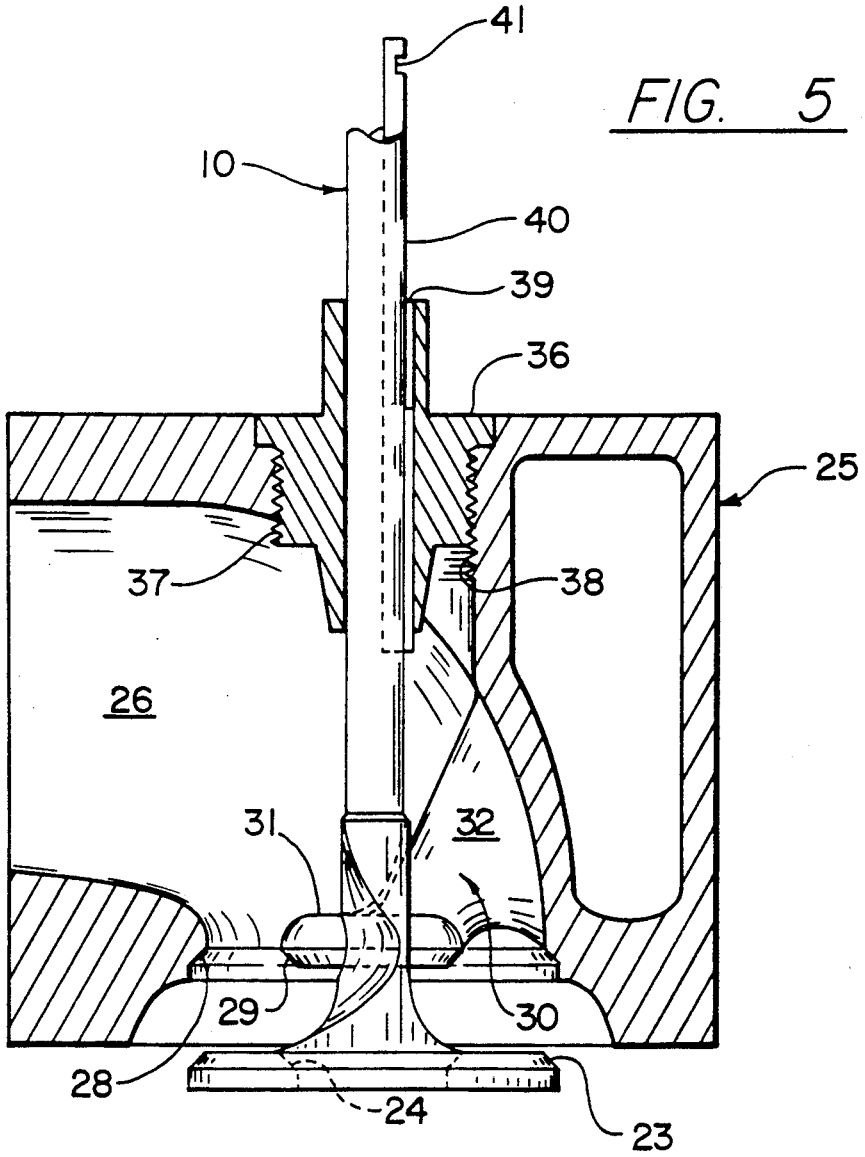
FIG. 5 is an elevational, partially sectioned view of an engine cylinder head showing the valve of FIG. 1 and the central valve seat cantilevered from the cylinder head with the valve in the open position.
Figure 6:
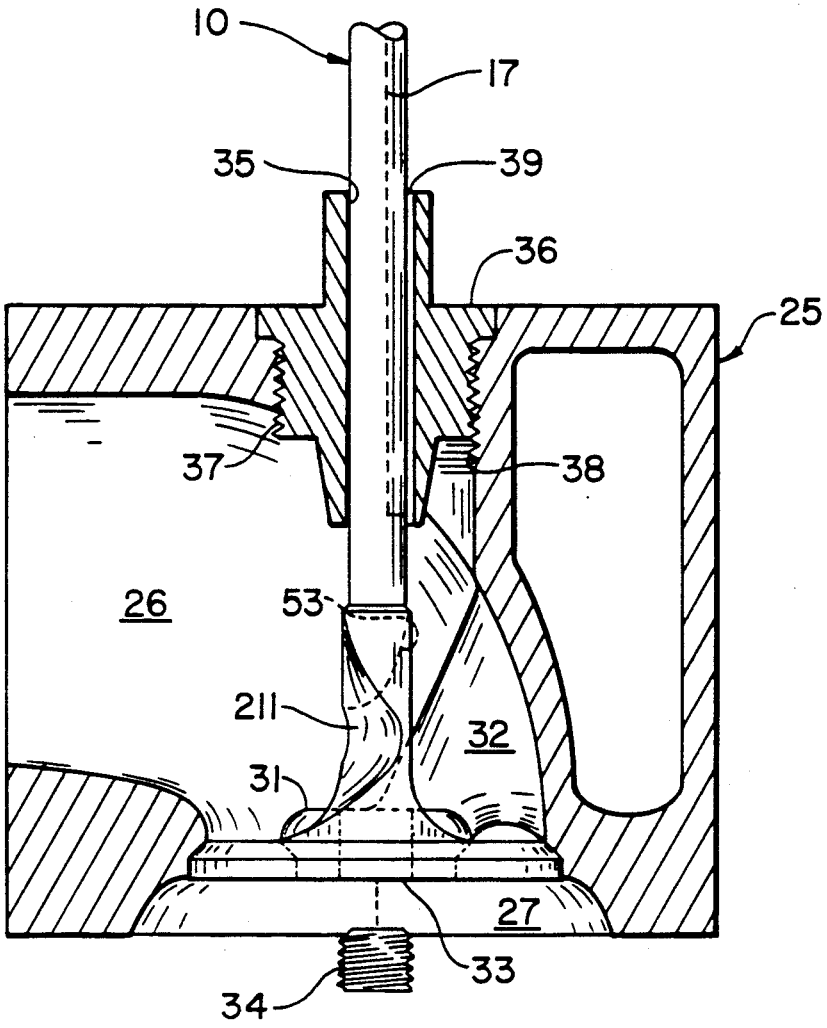
FIG. 6 is the same view as FIG. 5 with poppet valve of the present invention in the closed position.

FIGS. 5 and 6 show the preferred embodiment of the present invention incorporating the poppet valve 10 of the present invention in a modified conventional cylinder head 25 having a flow passage 26 and a combustion chamber 27. The peripheral seal 23 is adapted to seal with a peripheral seat 28 in the cylinder head 25, and the inner seal 24 is adapted to seal with the central valve seat 29 which is supported in fixed relation to the cylinder head 25 by the central support 30. As those skilled in the art will readily appreciate, it is the taper of the inner seal 24 towards the outer face 21 which allows the central valve seat 29 to be sealingly received within the valve body 19 against the inner seal 24. The central support 30 includes a seat body 31 which is supported within the flow passage 26 by a support arm 32. The support arm 32, in turn, is attached to and cantilevered from the cylinder head 25.

The central valve seat 29 is either formed into the seat body 31 or securely fixed to the seat body 31 so as to be integral therewith, and both the central valve seat 29 and the seat body 31 are coaxial with the longitudinal axis 16 of the poppet valve 10. The central valve seat 29 may be ground into the seat body 31 if the seat body 31 is made of the same material as the peripheral seat 28. If, however, the present invention is incorporated into, for example, an aluminum cylinder head 25 with an aluminum central support 30 and an iron peripheral seat 28, an iron central valve seat 29 should be attached to the seat body 31, as discussed below. The iron central valve seat 29 may be pressed, cast or screwed onto the seat body 31, or secured by using plug 34 as a fastener, or attaching the central valve seat 29 to the peripheral valve seat 28, or by other means known in the art.

The seat body 31 preferably has a threaded hole 33 extending therethrough concentric with the longitudinal axis 16 for alignment grinding of the peripheral and inner seats 28, 29, as shown in FIG. 6. A threaded plug 34, is used to seal the hole 33 once the alignment grinding has been completed.

The stem 13 of the poppet valve 10 is slideably received within the stem bore 35 of the valve guide 36. The valve guide 36 has threads 37 that cooperate with threads 38 in the cylinder head 25 to removeably secure the valve guide 36 to the cylinder head 25. The stem bore 35 has an axial groove 39 which extends along a portion of the stem 13 adjacent the axial slot 17.

Figure 7:
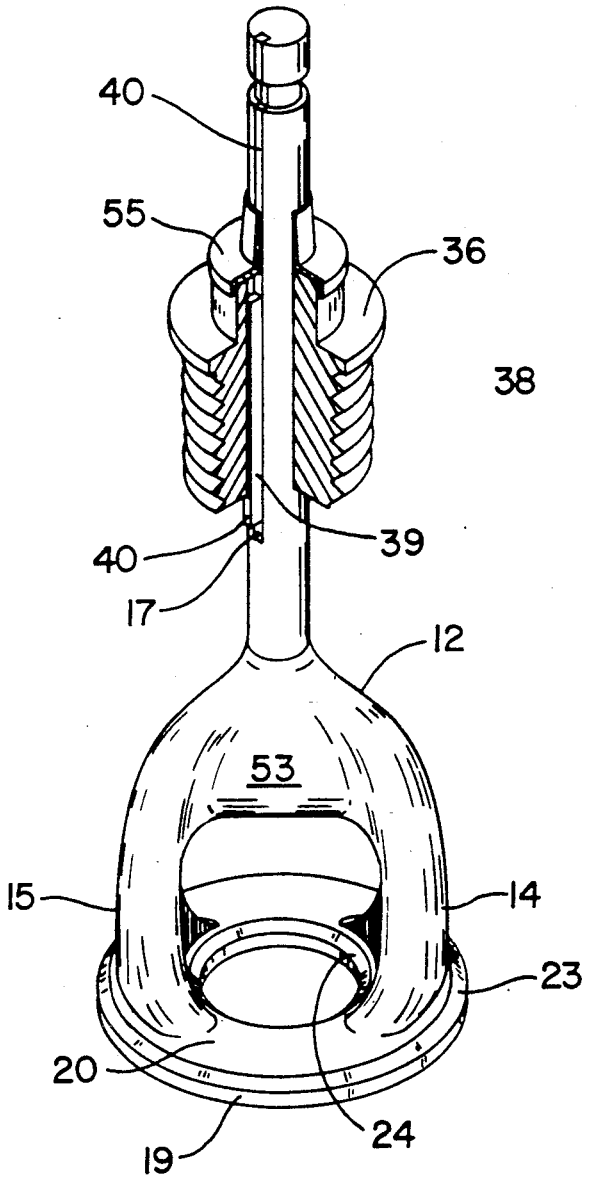
FIG. 7 is an elevational, partially sectioned view of the poppet valve of the present invention in place within the threaded valve guide.
Figure 8:
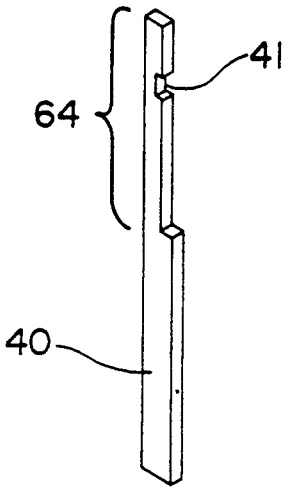
FIG. 8 is an elevational perspective view of a key for prevention of rotation between the valve and valve guide of the present invention.
Figure 9A:
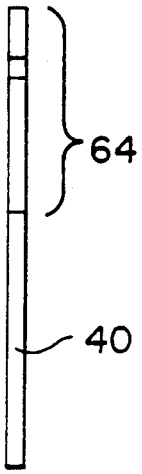
FIG. 9A is an elevational frontal view of the key of FIG. 8.
Figure 9B:
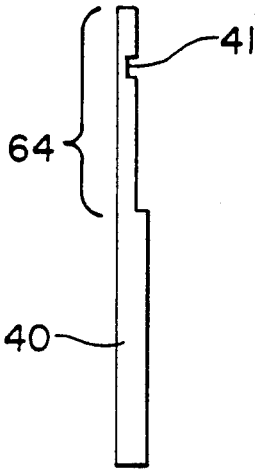
FIG. 9B is an elevational side view of the key of FIG. 8.

Referring to FIG. 7, a key 40 in the axial slot 17 extends into the axial groove 39, and is free to slide therein. The key 40, shown in greater detail in FIGS. 8 and 9, has a notch 41 which conforms to the annular groove 18 so that the presence of the key 40 in the axial slot 17 does not interrupt the annular groove 18. Likewise, the upper portion 64 of the key 40 is shallow so that when the key 40 is positioned within the axial slot 17 the upper portion 64 does not interfere with the oil seal 55, as shown in FIG. 7. The key 40 allows the stem 13 to move axially relative to the valve guide 36 while preventing rotation between the valve guide 36 and the stem 13.

Figure 10:
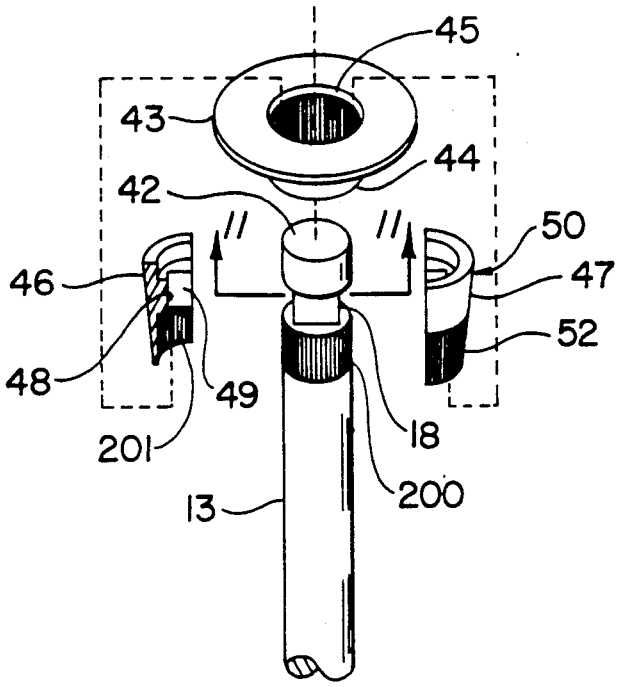
FIG. 10 is an exploded view of the conical retainer and spring plate which secures the poppet valve and prevents rotation of the present invention.
Figure 13:
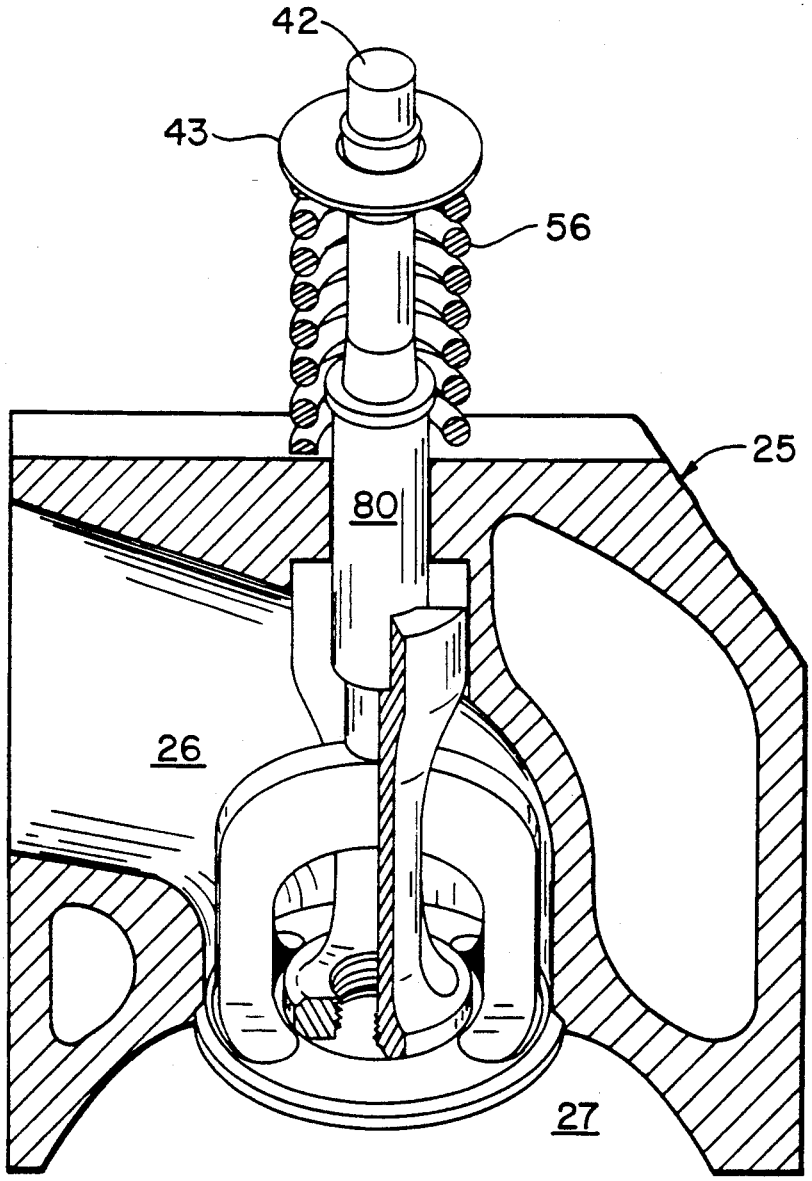
FIG. 13 is an elevational, partially sectioned view of an engine cylinder head showing the valve of FIG. 1 and second embodiment of the central support attached to the cylinder head with the valve in the closed position.

Referring to FIG. 10, the annular groove 18 adjacent to the outer end 42 of the stem 13 is for securing the spring plate 43 to the stem 13. The spring plate 43 has a sleeve 44 with a tapered bore 45 having a larger diameter than the stem 13. Two or more retainer sections 46, 47 having flanges 48, 49 which extend into the annular groove 18 form a conical retainer 50 about the stem 13, as shown in FIG. 13.

Figure 11:
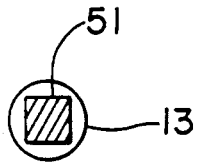
FIG. 11 is a cross-sectional view of the stem of the poppet valve of one embodiment of the present invention taken along line 11—11 of FIG. 10.

The largest outer diameter of the conical retainer 50 is greater than the smallest inner diameter of the tapered bore 45 such that the assembled conical retainer 50 cannot pass through the tapered bore 45 of the spring plate 43. As an anti-rotation feature, the annular groove 18 may be ground with a non-uniform cross-section, such as is shown in FIG. 11, which incorporates a plurality of flats 51. By designing the flanges 48, 49 of the retainer sections 46, 47 to fit snugly against these flats 51, the flanges 48, 49 prevent rotation of the conical retainer 50 about the stem 13. Additionally, the outer surface 52 of the conical retainer 50 and the bore 45 of the spring plate 43 may include axially extending threads 200 which cooperate with similar threads 201 on the inner surfaces of the connical sections 46, 47 to prevent rotation between the conical retainer 50 and the spring plate 43.

The preferred embodiment of the present invention is incorporated into an internal combustion engine cylinder head by casting the central seat support 30 integral with the cylinder head 25, and machining in the threads 38 to secure the valve guide 36. The hole 33 is bored through the seat body 31 and threaded. The valve guide 36 is then threaded into the cylinder head 25 to its fully seated position for surfacing of the peripheral and inner seats 28, 29.

Surfacing of the peripheral and inner seats 28, 29 may be accomplished by precision grinding of the peripheral and inner seats 28, 29 so as to provide sealing contact with the annualr seals 23, 24 of the valve body 19. The hole 33 is provided primarily to aid in surfacing of the seats 28, 29 so that when surfacing of the seats 28, 29 has been completed, the threaded plug 34 is secured therein to seal the hole 33. The valve guide 36 is then removed from the cylinder head 25, and the stem 13 of the valve 10 is inserted into the flow passage 26 between the seat body 31 and the peripheral seat 28. With the depression 53 facing the seat body 31, the stem 13 is inserted as far as possible into the cylinder head 25 and guided out the threaded guide opening 38 of the cylinder head 25. As those skilled in the art will readily appreciate, the curved portion 211 and the depression 53 allow the valve 10 to be installed in the cylinder head 25 through the clearance between the seat body 31 and the cylinder head 25 adjacent the peripheral seat 28. Once the hub 12 has been inserted past the seat body 31, the valve body 19 is positioned as shown in FIG. 6, and the valve guide 36 is slid down onto the top of stem 13 and threaded into the cylinder head 25 with the stem 13 slideably received within the stem bore 35.

With the axial slot 17 aligned with the axial groove 39, the key 40 is inserted into the axial slot 17, and an oil seal 55 is slid down onto the stem 13. A valve spring 56 is then placed over the stem 13 and compressed with the spring plate 43 on the stem 13 in the manner known in the art. The conical retainer 50 is set into the annular groove 18, and the spring 56 is then released against the spring plate 43, thereby pressing the spring plate 43 up onto the retainer 50 and securing the retainer 50 and spring plate 43 to the stem 13. It should be noted that in addition to retaining the spring plate 43, the conical retainer 50 also prevents the key 40 from sliding out of the stem 13 due to the presence of the notch 41. Additionally, although both a threaded retainer 50 and a key 40 are disclosed as means for preventing rotation of the valve 10, those skilled in the art will readily appreciate that in actual practice, only one of these is necessary. Furthermore, the present invention is not limited to any specific means for preventing rotation.

Figure 12:
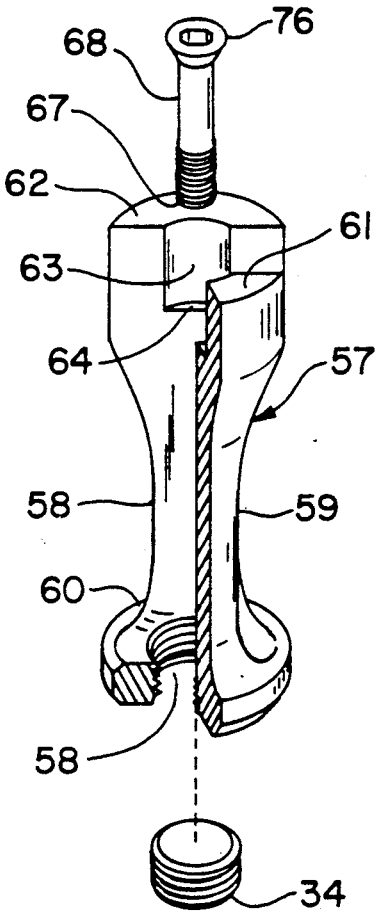
FIG. 12 is an elevational, partially sectioned view of a second embodiment of the central support of the present invention.
Figure 14:
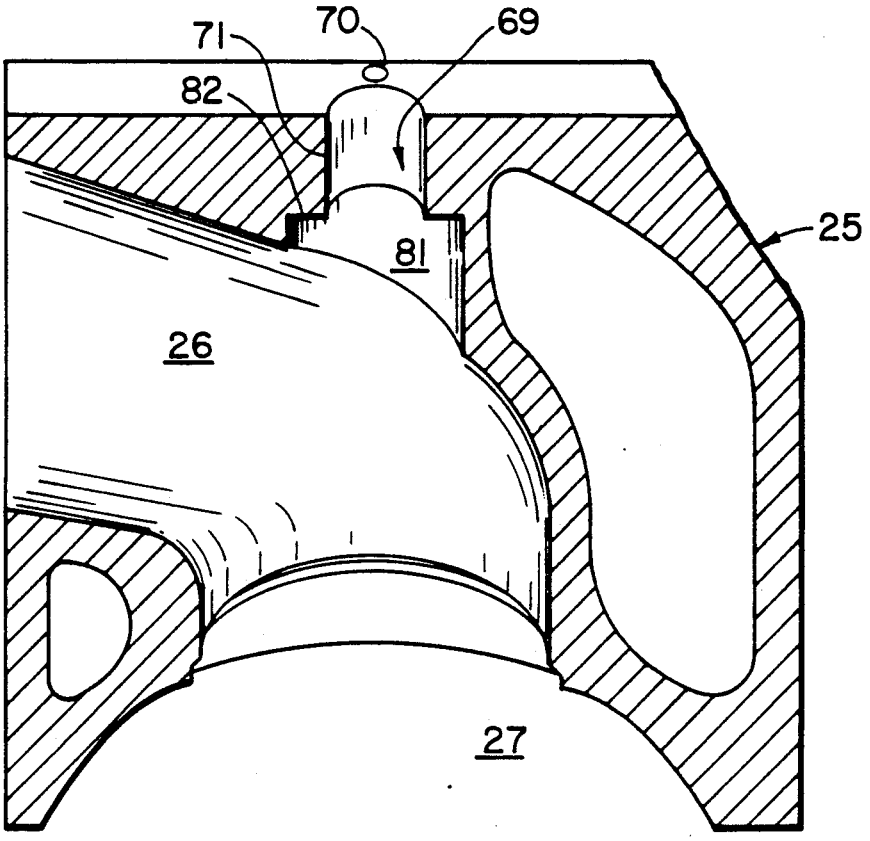
FIG. 14 is an elevational, cross-sectional view of an engine cylinder head showing the dual diameter cavity which receives the valve guide and central support of FIG. 13.

A second embodiment of the present invention incorporates the central support 57 shown in FIG. 12. The support 57 has two arms 58, 59 extending from the seat body 60. Adjacent the distal end 61, 62 of each arm 58, 59 is a semi-cylindrical recess 63 which extends axially along a portion of the arm 58, 59. The end 61, 62 of each arm 58, 59 is planar to conform to a land 82 in the cylinder head 25, and each end 61, 62 includes a bolt hole 67 to receive an attaching bolt 68. The arms 58, 59 are offset from the longitudinal axis 16 and spaced sufficiently apart from each other so that the stem 13 and hub 12 can pass freely between the arms 58, 59 as shown in FIG. 13. As shown in FIG. 14, a dual diameter cavity 69 is provided in the cylinder head 25 to receive the support 57, and cylinder head bolt holes 70 are provided on either side of the smaller diameter cavity 71.

To assemble the second embodiment, a sleeve type valve guide 80 is press-fitted into the smaller diameter 71 of the dual diameter cavity 69 as shown in FIG. 13, so that the valve guide 80 extends into the larger diameter cavity 81. The arms 58, 59 are then secured to the cylinder head 25 with the attaching bolts 68. Surfacing of seats 28, 29 is then accomplished as in the preferred embodiment. The central support 57 is removed, then assembled with valve 10 and reinstalled into position as shown in FIG. 13. It should be noted that the rotational orientation of the valve 10 and central support 57 with respect to the cylinder head 25 are for the purpose of clarity only and do not necessarily represent the optimum orientation for operating the valve 10 in an internal combustion engine.

Figure 15:
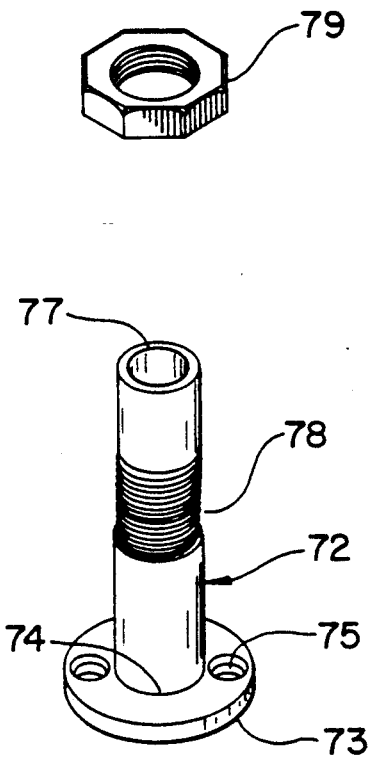
FIG. 15 is a side view in elevation of the flanged valve guide of the third embodiment of the present invention.

A third embodiment of the present invention, a flanged valve guide 72, is shown in FIG. 15. The flanged valve guide 72 has a flange 73 at one end 74 thereof, and the flange 73 has bolt holes 75 which align with the bolt holes 67 of the central support 57. The flange holes 75 are preferably countersunk so that the heads 76 of the bolts 68 do not interfere with positioning of the flanged valve guide 72 in the cylinder head 25. Additionally, the end 77 of the flanged valve guide 72 opposite the flange 73 has threads 78 to receive a nut 79 for securing the flanged valve guide 72 to the cylinder head 25.

If the flanged valve guide 72 is used, the valve guide 72 is not press fitted into the cylinder head 25. Instead, once the central support 57 has been placed within the valve 10 as shown in FIG. 13, the flanged valve guide 72 is slid down over the stem 13 and bolted to the central support 57. The valve 10 and support 57 are then installed into the cylinder head 25 as a unit by sliding the threads 78 of the flanged valve guide 72 through the cylinder head 25, and securing the valve guide 72 therein with a nut 79.

Figure 16:
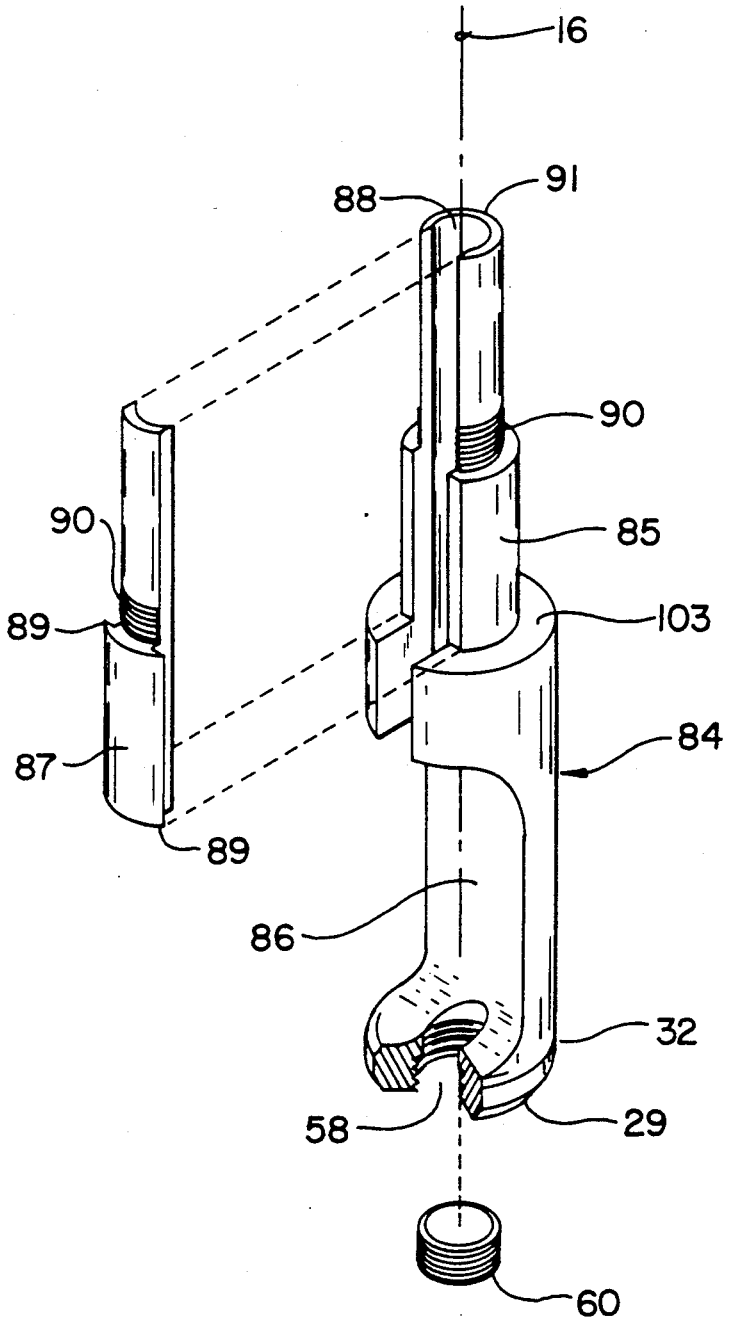
FIG. 16 is an elevational, partially sectioned view of the central support of the fourth embodiment of the present invention.

A fourth embodiment of the present invention includes a support 84 as shown in FIG. 16. The support 84 is integral with the valve guide 85 and has a first arm 86 offset from the longitudinal axis 16 to provide adequate clearance between the arm 86 and the hub 12 of the valve 10. Additionally, the support 84 includes a cap section 87 which is removable, and once removed, allows the valve stem 13 to be laid directly into the stem bore 88 thereof. When the cap section 87 is replaced, the valve stem 13 is slideably retained within the stem bore 88. The cap section 87 includes a land 89 on either side of the cap section 87 to prevent the cap section 87 from sliding too far into the valve guide 85 and binding the stem 13.

To surface the support 84 shown in FIG. 16, the support 84 is secured to the cylinder head 25 without the valve 10, and the peripheral and central valve seats 28, 29 are surfaced. The support 84 is then removed from the cylinder head 25. With the peripheral and inner seals 23, 24 of the valve 10 surfaced, the valve 10 stem 13 set into valve guide 85 and the cap section is placed over the stem 13. The valve 10 and support 84 are installed into the cylinder head 25 as a single unit by sliding the stem 13 and valve guide 85 through the dual diameter cavity 69 until the threads 90 adjacent the end 91 of the valve guide 85 protrude through the cylinder head 25 and the flange land 103 on the support 84 rests on the land 82 of the cylinder head 25. A nut is then threaded onto the threads 90, securing the support 84 to the cylinder head 25. As those skilled in the art will readily appreciate, any of the above-described means of preventing rotation between the valve guide 85 and the stem 13 can be incorporated in the support 84.

Figure 17:
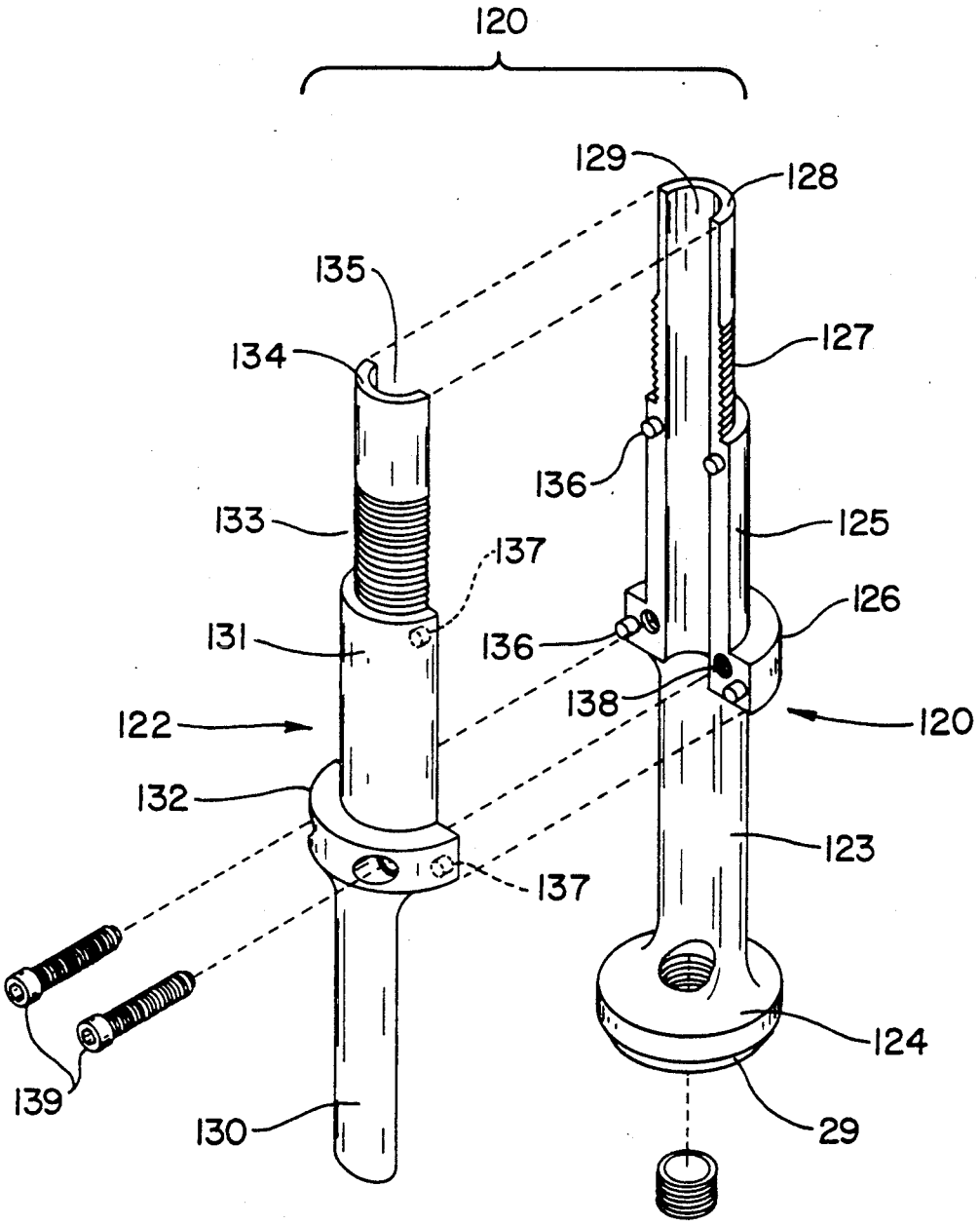
FIG. 17 is an elevational, partially sectioned view of the central support of the fifth embodiment of the present invention.
Figure 18:
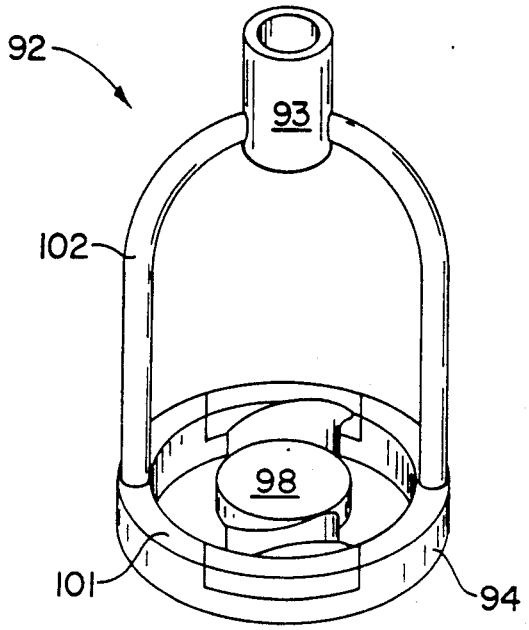
FIG. 18 is a side view in elevation of the cast-in-place valve guide/peripheral seat member and central support member assembly of the sixth embodiment of the present invention.
Figure 19:
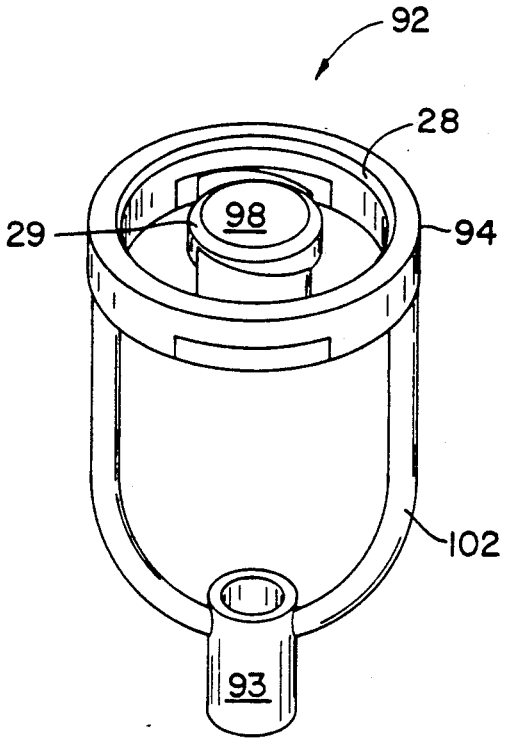
FIG. 19 is a reverse elevation view of the assembly of FIG. 18.
Figure 20:
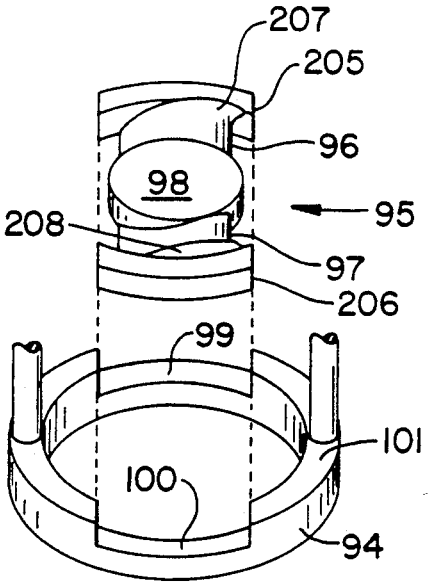
FIG. 20 is an exploded view of the peripheral seat member and central seat support member.
Figure 21:
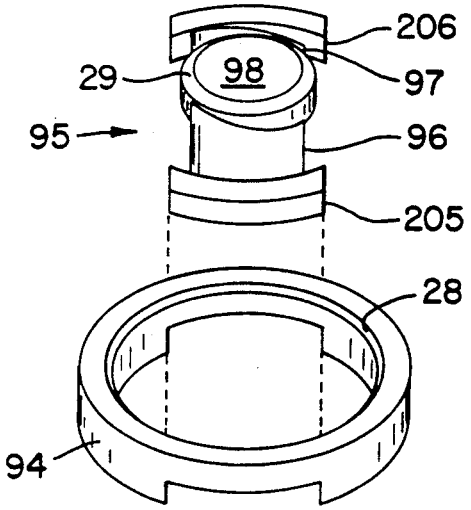
FIG. 21 is an exploded view in reverse elevation of the peripheral seat member and central seat support member of FIG. 20.

A fifth embodiment of the present invention incorporates a central support 120 as shown in FIG. 17. The support 120 includes two parts 121, 122. The first part 121, has a seat body 124 having an inner seat 29 and an integral arm 123 extending therefrom. The opposite end of the arm 123 is integral with a half-sleeve 125. The half-sleeve 125 includes an alignment flange 126 adjacent the integral arm 123, and a threaded portion 127 adjacent the distal end 128. A concave channel 129 extends longitudinally through the half-sleeve 125, the channel 129 having a diameter slightly larger than the diameter of the stem 13 to slideably receive the stem 13 therein. The second part 122 includes an second arm 130 integral with another half-sleeve 131 that likewise includes an alignment flange 132, and a threaded portion 133 adjacent the distal end 134 thereof. In addition, the half-sleeve 131 of the second part 122 has a concave channel 135 similar to the previously discussed channel 129. The first part 121 has a plurality of alignment pins 136 extending from the seat body 124 and the half-sleeve 125 which are received within holes 137 (shown in phantom) in the second arm 130 when the half-sleeves 125, 131 are mated. The first half-sleeve 125 also includes two threaded bolt holes 138 for receiving the bolts 139 which are used to secure the first and second parts 121, 122 together.

To surface the support 120 shown in FIG. 17, the support 120 is secured to the cylinder head 25 without the valve 10, and the peripheral and central valve seats 28, 29 are surfaced. The support 120 is then removed from the cylinder head 25. With the peripheral and inner seals 23, 24 of the valve 10 surfaced, the valve 10 stem 13 set into one half of the valve guide 125 and the other half 122 is placed over the stem 13 with the pin holes 136 receiving the pins 137 therein. The bolts 139 are then used to secure the two halves 121, 122 together. The valve 10 and support 120 are installed into the cylinder head 25 as a single unit by sliding the stem 13 and valve guide halves 125, 131 through the dual diameter cavity 69 until the threads 127, 133 adjacent the end 128, 134 of the valve guide protrude through the cylinder head 25. A nut is then threaded onto the threads 127, 133, securing the support 120 to the cylinder head 25.

In those applications where the cylinder head 25 is cast using a material having a lower melting point than the material from which the valve 10 and valve seats 28, 29 are formed, as disclosed in U.S. Pat. No. 4,688,527 issued Aug. 25, 1987 to Mott el al. and incorporated herein by reference, a sixth embodiment of the present invention may be incorporated. As shown in FIGS. 18–21, the sixth embodiment includes a two piece assembly 92. The first piece is an integral valve guide 93 which is connected to the peripheral seat member 94 by connecting arms 102, and the second piece in an aerodynamically shaped central support 95. The valve guide 93 may have an axial groove (not shown) for receiving the key 40 as described above, and the valve guide 93 is held in fixed relation to the peripheral seat member 94 by connecting arms 102. The central support 95 has spokes 96, 97 extending from the seat body 98, and the rim ends 205, 206 of each spoke 96, 97 are removeably received within notches 99, 100 in the inner surface 101 of the peripheral seat member 94. Each of the spokes 96, 97 has a built-up portion 207, 208 which secures the spoke 96, 97 to the rim end 205, 206. The purpose of the built-up portion 207, 208 is to support the seat body 98 against the force of combustion.

To incorporate the sixth embodiment into a cylinder head 25, the aerodynamically shaped central support 95 is removed from the peripheral seat member 94. A valve 10 such as is shown in FIG. 1 with or without depression 53 or curvature of the hub 12 and curvature of the posts 14, 15, is inserted into the sixth embodiment by feeding the stem 13 through the peripheral seat member 94 and then sliding the stem 13 through the valve guide 93 until the peripheral seal 23 is in contact with the peripheral seat 28 of the peripheral seat member 94. The central support 95 is then placed back into the sixth embodiment, and the assembly 92 is ready to be cast as a unit into a cylinder head 25. Depending on the specific cylinder head to be cast, temporary fasteners or supports may be necessary to maintain correct alignment of the parts during the casting process. Neither the depression 53 nor the curvature of the hub 12 and curvature of the posts 14, 15 are necessary for the embodiment just described, and may be omitted.

When used as an intake valve, the aerodynamically shaped spokes 96, 97 should be oriented with respect to incoming flow so as to produce the minimum flow resistance, which, as those skilled in the art will readily appreciate, is dependent on the flow paths within the particular cylinder head design.

Figure 22:
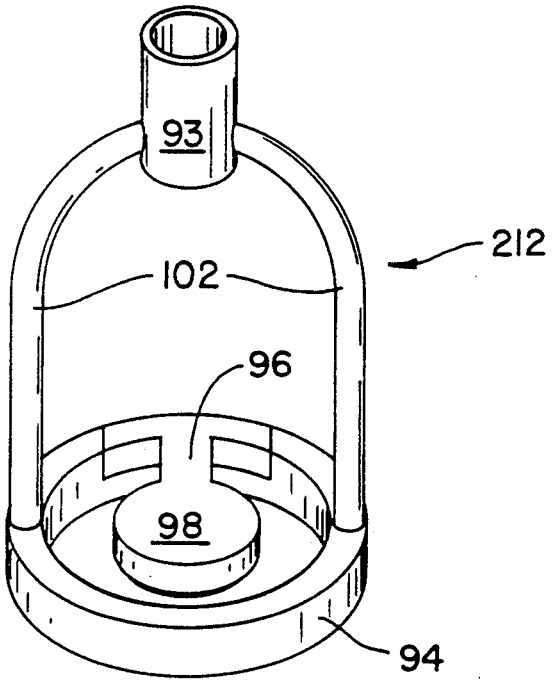
FIG. 22 is a side view in elevation of the single-spoked version of the cast-in-place valve guide/peripheral seat member and central support member assembly of the present invention.

Alternately, a single-spoked version 212 as showing in FIG. 22 may be incorporated into the casting of the central support 30 of FIG. 5. In the single-spoked version, the seat body 98 is cantilevered from the peripheral seat member 94 by a single spoke 96 which is integral with the seat body 98 and removeable from the peripheral seat member 94, and is aligned with the to-be-cast central support 30. When the central support 30 is cast around the single spoke 96, the central support 30 fixes the position of the seat body 98, and the single spoke 96 serves no further purpose. Since, in most applications, the single spoke 96 is buried within the casting material which fixes the central support 30 to the wall of the flow passage, no aerodynamic shaping of the spoke 96 is necessary.

Although this invention has been shown and described with respect to a detailed embodiments thereof, it will be understood by those skilled in the art that various changes in form and detail thereof may be made without departing from the spirit and scope of the claimed invention.

I claim:

1. A valve, for use in a cylinder head of an internal combustion engine, comprising a superior portion including a hub, a stem attached to said hub and extending therefrom along a longitudinal axis, and a plurality of posts attached to said hub and extending therefrom substantially parallel to said longitudinal axis;

a valve body including first and second opposed faces, each of said posts attached to said first face, said first face including first and second annular sealing surfaces, said first sealing surface coaxial with said second sealing surface and tapering toward said stem, and said second sealing surface tapering toward said second face; and, an internal port extending between said first and second faces, said internal port consisting of a single opening extending from the second sealing surface to the second face.

2. The valve of claim 1 wherein the superior portion includes at least two posts that are integral with the valve body and the hub, and the stem is integral with the hub.

3. The valve of claim 2 wherein the valve body is a disk, said internal port is located in the center of the disk and concentric with the longitudinal axis, and said second sealing surface immediately adjacent and encompassing the internal port.

4. The valve of claim 3 wherein the hub includes a depression between the two posts and a curved portion opposite the depression.

5. A valve assembly for a cylinder head of an internal combustion engine, said valve assembly comprising a valve including a superior portion including a hub, a stem attached to said hub and extending therefrom into the cylinder head along a longitudinal axis, and a plurality of posts attached to said hub and extending therefrom substantially parallel to said longitudinal axis;

a valve body including first and second opposed faces, each of said posts attached to said first face, said first face including first and second annular sealing surfaces, said first sealing surface coaxial with said second sealing surface and tapering toward said stem, said first sealing surface adapted to seal with a first seat in said cylinder head, said second sealing surface tapering toward said second face and adapted to seal with a second seat, and an internal port extending between said first and second faces, said internal port coaxial with the longitudinal axis and consisting of a single opening extending from the second sealing surface to the second face; and, a support extending from said cylinder head and having a seat body at one end thereof, said second seat integral with said seat body and supported in fixed relation to the cylinder head.

6. The valve assembly of claim 5 wherein the valve body is disk shaped, said internal port is located in the center of the valve body, and said second sealing surface immediately adjacent and encompassing the internal port.

7. The valve assembly of claim 6 wherein the stem includes means for attaching a spring plate to one end of the stem, the stem is slideably received within a valve guide, and said valve guide is fixedly received within the cylinder head.

8. The valve assembly of claim 7 wherein the superior portion includes at least two posts that are integral with the valve body and the hub, and the stem is integral with the hub.

9. The valve assembly of claim 8 wherein the hub includes a depression between the two posts and is curved opposite the depression to provide for clearance between the hub and the seat body, and the thickness of the hub at the depression is less than the distance between the first and second annular seats.

10. The valve assembly of claim 8 wherein the support includes at least one arm extending from said seat body to the cylinder head, said arm offset from the longitudinal axis of the stem.

11. The valve assembly of claim 10 wherein said arm terminates in a valve guide, said valve guide is fixedly received within the cylinder head, said stem is slideably received within said valve guide, and said stem includes means for preventing rotation between said valve guide and said stem.

12. The valve assembly of claim 11 wherein the seat body includes a threaded plug and a threaded hole, said hole concentric with said longitudinal axis and said plug threaded into said hole.

13. The valve assembly by claim 8 wherein the support includes first and second arms extending from said seat body to the cylinder head, said first arm in spaced relation to the second arm, each of said arms is offset from the longitudinal axis of the stem, and each arm is fixedly secured to the cylinder head.

14. The valve assembly of claim 13 further comprising a valve guide fixedly received within the cylinder head, each arm includes a recessed portion therein, an end portion of the valve guide is received within said recessed portions in contact therewith, said stem is slideably received within said valve guide, and said stem includes means for preventing rotation between said valve guide and said stem.

15. The valve assembly of claim 14 wherein the seat body includes a threaded plug and a threaded hole, said hole concentric with said longitudinal axis and said plug threaded into said hole.

16. The valve assembly of claim 8 wherein the arm is cantilevered from the cylinder head, and the assembly further comprises a valve guide fixedly received within the cylinder head, said stem slideably received within said valve guide, said stem including means for preventing rotation between said valve guide and said stem.

17. The valve assembly of claim 16 wherein the seat body includes a threaded plug and a threaded hole, said hole concentric with said longitudinal axis and said plug threaded into said hole.

18. A valve assembly for a cylinder head of an internal combustion engine, said valve assembly comprising a valve including a superior portion including a hub, a stem and two posts, said stem integral with the hub and extending therefrom into the cylinder head along a longitudinal axis, said stem having an axial slot and means for attaching a spring plate to one end of the stem, and each post integral with the hub and extending therefrom;

a valve body including an internal port and first and second opposed faces, each of said posts attached to said first face, said first face including first and second annular sealing surfaces, said first sealing surface adapted to seal with a first seat in said cylinder head, said first sealing surface coaxial with said second sealing surface and tapering toward said stem, said second sealing surface tapering toward said second face and adapted to seal with a second seat, and said internal port extending between said first and second faces, said internal port concentric with said longitudinal axis; and, a support extending from said cylinder head and having a seat body at one end thereof, said second seat integral with said seat body and supported in fixed relation to the cylinder head;

wherein said valve is selectively positionable between a first position at which the first and second sealing surfaces sealingly contact the first and second seats, respectively, and a second position at which the first sealing surface is in spaced relation to the first seat, thereby defining a first flow path therebetween, and the second sealing surface is in spaced relation to the second seat, thereby defining a second flow path therebetween.

19. For molded inclusion in a cast metal cylinder head of an internal combustion engine, an integral ceramic valve seat and valve stem guide assembly for operative engagement and support of a poppet type valve with its enlarged valve body with first and second sealing surfaces the first surface coaxial with the second surface, and an elongated cylindrical stem portion, comprising:

first valve seat forming means cast in ceramic material having a first annular configuration operatively conforming to the configuration of the first sealing surface of the valve and defining an annular seating surface for sealing engagement with the valve body when the valve is in a closed position, said first valve seat forming means including at least one notch on a surface thereof opposite the annular seating surface;

valve stem support means cast in ceramic having a generally tubular configuration with an internal bore and defining a support for reciprocation of the cylinder stem portion of the valve as the valve moves between open and closed operative position;

connecting means cast in ceramic and integral with both the valve seat forming means and the valve stem supporting guide means for aligning the means so that a plane through the annular seating surface is normal to the axis of the tubular guide means and coaxially supporting the first annular valve seat and the tubular guide portion;

second valve seat forming means cast in ceramic material having a seat body including a second seating surface having an annular configuration operatively conforming to the configuration of the second sealing surface of the valve and defining a second annular seating surface for sealing engagement with the second sealing surface of the valve body when the valve is in a closed position, said second valve seat forming means including at least one spoke extending radially outward from the seat body, the spoke having an end portion which conforms to the notch for engagement therewith, said second valve seat forming means removably engageable with said first valve seat forming means such that the first and second annular seating surfaces are coaxial;

wherein the integral first valve seat forming means, valve stem guide means and connecting means, and the second valve seat forming means are included during the casting formation of the metal cylinder head to form an aligned valve seating and supporting structure.

20. The ceramic valve seat and valve stem guide assembly of claim 19 wherein the first valve seat forming means includes two notches and the second valve seat forming means includes two spokes extending radially outward from the seat body, each spoke having an end portion which conforms to one of the notches for engagement therewith, said second valve seat forming means removably engageable with said first valve seat forming means such that the first and second annular seating surfaces are coaxial.

* * * * *